United States Patent [19]

Moore

[11] 4,300,457

[45] Nov. 17, 1981

[54] ADJUSTABLE SUBMERGED SCRAPER CONVEYOR SEAL TROUGH

[75] Inventor: Richard F. Moore, Tolland, Conn.

[73] Assignee: Combustion Engineering, Inc., Windsor, Conn.

[21] Appl. No.: 140,059

[22] Filed: Apr. 14, 1980

[51] Int. Cl.[3] ..... F23J 1/02

[52] U.S. Cl. ..... 110/171; 110/165 R; 277/14 V; 277/135

[58] Field of Search ..... 277/14 V, 135; 110/165 R, 170, 171

[56] References Cited

U.S. PATENT DOCUMENTS

| | | | |
|---|---|---|---|
| 1,188,255 | 6/1916 | Duckham | 110/171 |
| 2,037,990 | 4/1936 | Martin | 110/171 |
| 3,734,037 | 5/1973 | Martin | 110/171 |
| 3,915,105 | 10/1975 | Michelbrink | 110/171 |
| 4,112,856 | 9/1978 | Fuhrman et al. | 110/171 |
| 4,213,402 | 7/1980 | Kochey | 110/171 |

*Primary Examiner*—Henry C. Yuen

*Attorney, Agent, or Firm*—Robert L. Olson

[57] ABSTRACT

Apparatus for handling ash and slag produced in the combustion of coal or other ash-bearing fuel in the furnace (10) of a steam generator, including a submerged scraper conveyor (14) beneath the furnace (10), and a water seal (22) including a trough (26) between the two for preventing the atmosphere from being exposed to the furnace interior. A hydraulic actuator (40,42) is prodived for allowing submerged scraper conveyor (14) to be quickly removed from beneath the furnace (10) when the unit is shut down for maintenance purposes.

3 Claims, 2 Drawing Figures

ADJUSTABLE SUBMERGED SCRAPER CONVEYOR SEAL TROUGH

BACKGROUND OF THE INVENTION

In coal-fired steam generators, the manner in which the ash is handled and disposed of is an item of considerable importance. One means used today for continuously removing ash and slag which falls through an opening in the furnace bottom is a scraper conveyor which is submerged in a tank of water. When the unit is shut down for periodic maintenance, it is desirable to be able to move the entire scraper conveyor unit, including the tank in which it is housed, from beneath the furnace so that it can be easily worked on, and so that it can be replaced with another unit if major repair is required.

A water seal is generally provided for preventing the atmosphere from being exposed to the furnace interior. This consists of a plate extending down and surrounding the furnace bottom opening, which plate extends into a trough secured to the upper end of the submerged scraper conveyor tank, which trough is filled with water, thus forming a water seal. This type of seal is provided because it allows the furnace to grow relative to the submerged scraper conveyor unit caused by thermal expansion. Large furnaces are generally top supported, so they are free to expand in a downward direction when the unit is first started up. This growth can be on the order from 10 to 12 inches from the cold to the hot condition.

The above provides the problem of how to be able to quickly remove the submerged scraper conveyor unit from beneath the furnace when the unit is shut down for maintenance. In the past, it has been necessary to allow the unit to cool down to a point when workmen can unbolt the seal plates from the furnace bottom. This cooling and unbolting time is considerable and can cause the entire steam generator to be down for lengthy maintenance periods.

SUMMARY OF THE INVENTION

In accordance with the invention, a submerged scraper conveyor unit is provided beneath a coal-fired furnace, and a water seal is provided therebetween to prevent the furnace gases from escaping to the atmosphere. This water seal is formed by providing plates extending down from the furnace bottom into a water-filled trough integral with the submerged scraper conveyor tank. The trough is capable of being moved outwardly and downwardly by a hydraulic actuator so that it can be moved upwardly into sealing relationship during operation of the furnace, and can be moved to its down position during a maintenance shut-down, so as to permit the submerged scraper conveyor tank to be removed from under the furnace.

DESCRIPTION OF THE PREFERRED EMBODIMENT

Figure 1:
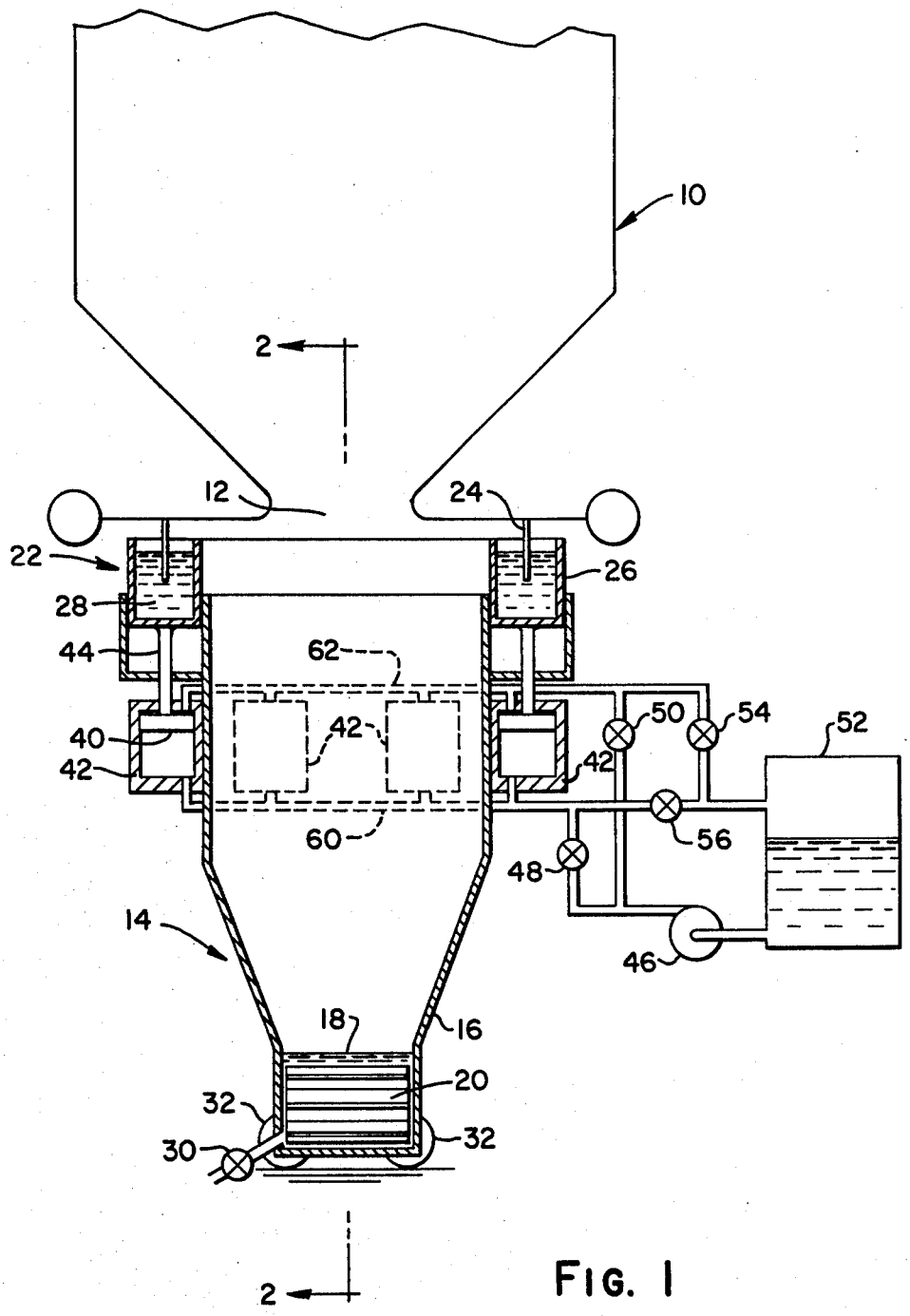
FIG. 1 is a sectional side view of a submerged scraper conveyor unit beneath a furnace constructed in accordance with the present invention.
Figure 2:
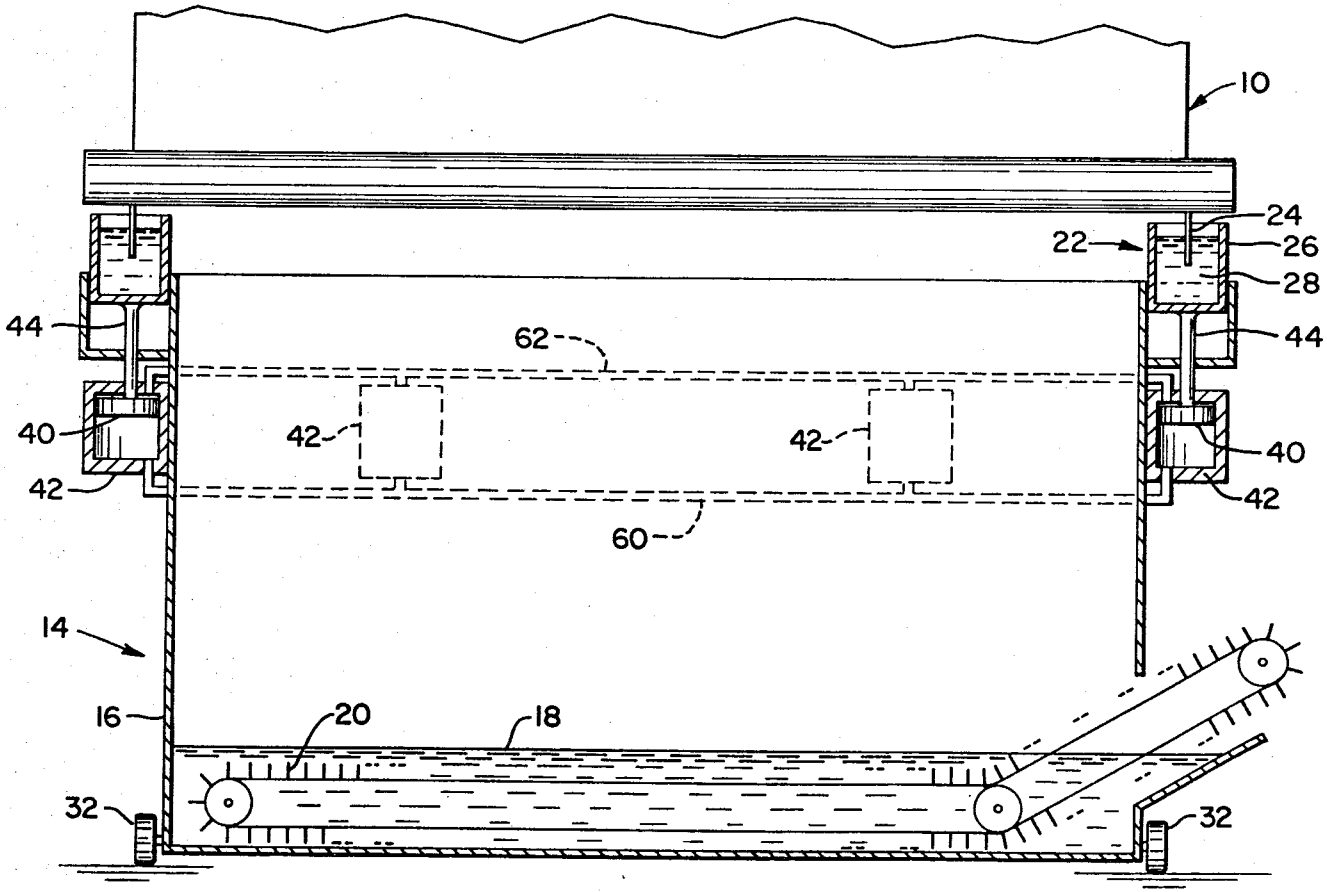
FIG. 2 is a view taken on line 2—2 of FIG. 1.

Looking now to the drawings, numeral 10 designates a furnace of a steam generator in which coal is burned. Molten ash and slag are discharged through the furnace bottom opening 12, and falls into the submerged scraper conveyor unit 14. The tank 16 is filled with water 18, and contains a conveyor belt 20 with integral scraper blades in the bottom thereof by means of which the cooled ash and slag is continuously removed from the tank (FIG. 2). The upper run of the conveyor 20 carries the clinkers to the end of the tank (FIG. 2), where they can be discharged into trucks or onto a mechanical conveyor (not shown), and transported away. A portion of the water in the tank is constantly removed and replenished to maintain the main body of water at a temperature not exceeding 160° F.

A water seal 22 permits thermal expansion of the top-supported furnace 10 while preventing exposure of the interior thereof to the atmosphere. The water seal 22 is formed by plates 24 which are secured to the bottom of the furnace, and extend downwardly into trough 26. Both the plates 24 and the trough 26 extend around the entire periphery of the opening 12, so as to completely seal the opening between the furance 10 and the submerged scraper conveyor unit 14. During operation of the furnace, the trough 26 is filled with water 28 so as to form the seal.

The tank 16 is provided with a drain 30, so that it can be emptied during a maintenance shut-down. The tank is also mounted on wheels 32, so that it can be quickly moved from beneath the furnace 10 during a shut-down. The trough 26 is hydraulically actuated, so that during furnace operation it is in its upper position, in sealing relationship with the sealing plates 24. When it is desired to move the tank 16, during a maintenance shut-down, the trough 26 is moved to its lower position, so that it is located beneath and will clear the plates 24 during sideways movement.

The bottom of trough 26 is secured to a piston-cylinder arrangement 40, 42 by rod 44. Hydraulic fluid can be pumped by pump 46 beneath the piston 40 through valve 48, and above the piston 40 through valve 50. Fluid can return to the storage or sump tank 52 from above and below the piston 40 through valves 54 and 56, respectively. As shown, there are two piston-cylinder arrangements located on each of the four sides of the trough 26, so that it moves up and down smoothly without binding in the channels. All eight of the piston-cylinders are supplied and drained of hyrdaulic fluid through lines 60 and 62, which extend all the way around the tank 16.

The manner in which the sealing trough 26 is operated should now be apparent. When it is desired to move the submerged scraper conveyor unit 16 from beneath the furnace 10, the pump 46 is actuated and valve 50 and 56 are opened. Valve 50 permits fluid to flow to hydraulic line 62, forcing the pistons 40 downwardly. Fluid simultaneously drains from line 60 into sump 52. Limit switches (not shown) which are actuated by the trough 26 can be used to stop the pump 46 and close the valves when the trough is in its proper upper or lower position, as the case may be. Tank 16 is drained of water through valve 30 and the tank 16 can then be moved from beneath the furnace 10 to be worked on. If major work is required, a second or spare tank can be placed beneath the furnace while the other one is being fixed or repaired.

When the unit is to be put back into operation, the tank 16 is first positioned beneath the furnace 10. Pump 46 is actuated, and valves 48 and 54 are opened. Valve 48 admits fluid to line 60, forcing piston 40 upwardly while fluid drains from line 62 into the sump 52 through valve 54. Tank 16 is meanwhile being filled with water. The furnace 12 can thereafter be fired with coal or other ash-bearing fuel.

I claim:

1. An ash-disposal system for ashes discharged from a coal-fired or other ash-bearing fuel-fired combustion chamber, including opening means in the furnace bottom, a tank open at its upper end and containing water positioned beneath the opening means, into which the ash from the combustion chamber falls, means for removing the ash from the tank, a water seal between the furnace bottom and the tank for sealing the furnace interior from exposure to the atmosphere, the water seal including plate means secured to and extending down from the furnace bottom, which plate means completely surround the opening means, a water filled trough secured to the upper end of the tank which completely surrounds the opened upper end of the tank, a trough having first and second positions, the first position being such that the plate means extend down into the water within the trough, and the second position being such that the trough is located beneath the plate means, and piston-cylinder actuated means for moving the trough between the first and second position.

2. The ash-disposal system set forth in claim 1, wherein the tank is mounted on wheels.

3. The ash-disposal system set forth in claim 2, wherein the piston-cylinder actuator means consists of a pair of piston-cylinders on each of the four sides of the trough.

* * * * *